US005458027A

United States Patent [19]

Rambin

[11] Patent Number: 5,458,027

[45] Date of Patent: Oct. 17, 1995

[54] OIL FILTER WRENCH

[76] Inventor: Glen D. Rambin, 904 Krause St., Westlake, La. 70669-4616

[21] Appl. No.: 285,965

[22] Filed: Aug. 4, 1994

[51] Int. Cl.[6] ..... B25B 13/52

[52] U.S. Cl. ..... 81/64; 81/3.43

[58] Field of Search ..... 81/3.43, 64

[56] References Cited

U.S. PATENT DOCUMENTS

| | | | |
|---|---|---|---|
| 3,962,936 | 6/1976 | Lewis . | |
| 4,010,662 | 3/1977 | Perrault . | |
| 4,079,642 | 3/1978 | Scott . | |
| 4,221,140 | 9/1980 | Bracey et al. . | |
| 4,249,296 | 2/1981 | Colburn | 81/64 X |
| 4,860,617 | 8/1989 | Robbins . | |
| 5,115,700 | 5/1992 | Kaler, 2nd . | |

FOREIGN PATENT DOCUMENTS

| | | |
|---|---|---|
| 1201663 | 1/1968 | United Kingdom . |

*Primary Examiner*—James G. Smith
*Attorney, Agent, or Firm*—William W. Stagg

[57] ABSTRACT

A strap wrench for removing oil filters comprising a first flexible strap having a hand loop formed at one end and a second strap mounted perpendicular to first flexible strap at the other end. The second strap is of sufficient length to form protruding tabs at each edge of the first flexible strap, the first flexible strap having sufficient flexibility to be formed into a plurality of rolls around the tabbed second end so as to allow the rolled strap to be placed over an oil filter and tightened against the oil filter by holding at least one of the protruding tabs against the oil filter and pulling on the hand loop for turning the oil filter.

9 Claims, 2 Drawing Sheets

OIL FILTER WRENCH

FIELD OF INVENTION

The present invention generally relates to oil filter wrenches and more particularly relates to an improved oil filter strap wrench for removal of cylinder type screw on oil filters.

BACKGROUND OF INVENTION

It is necessary to change automotive engine oil and oil filters periodically to prevent engine wear. The oil filters typically used in automotive engines are of a barrel cylinder type which screw on to and off of the engine block. Removing the oil filter from the engine block may be difficult and time consuming depending upon the engine design, the clearance available around the filter and the degree in which the screw on oil filter has been tightened against the engine block.

Efforts have been made to provide tools to facilitate Oil filter removal. One such device is that described in U.S. Pat. No. 4,860,617 to Robbins. Robbins describes a strap type oil filter wrench which is comprised of a long flexible strap with an adjustable loop at one end. A stop mounted to the strap prevents movement of the loop along the strap to facilitate holding the loop in an open position.

Another device is that described in U.S. Pat. No. 5,115,700 to Kaler, 2nd. Kaler, 2nd discloses a strap wrench made of a semi-rigid, form retaining planer strip wrap around. The wrap around forms a shape retaining adjustable loop held open by guides. A pull cord is attached to one end of the planer strip and wrapped around the loop to rotate the oil filter as the cord is pulled.

Another device for removing oil filters has been described and illustrated in U.S. Pat. No. 4,221,140 to Bracey, et al. The Bracey patent discloses a device having a bolt with a slot through its rod into which is fitted an endless fabric strap. The bolt has a head which is sized to fit a conventional wrench. The strap is fitted around the oil filter and as the bolt head is turned by the wrench, the strap is tightened around the filter for rotating the filter as the head is turned.

Another strap wrench is that disclosed in U.S. Pat. No. 3,962,936 to Lewis. Lewis describes a rotatable wrenching member such as a bolt having slots into which is insert both ends of a flexible strap to form a bight. The size of the bight is adjustable by sliding the bolt along the strap. Rotating the wrenching member tightens the strap and turns an annular body such as an oil filter.

Another flexible strap wrench device used to rotate tubular members is disclosed in U.S. Pat. No. 4,010,662 to Perrault. The Perrault patent discloses an apparatus that discloses a flexible strap with handles at either end. Raised ribs form a surface on one side of the strap for gripping the object to be rotated as the strap ends are pulled.

Another strap apparatus for removing oil is illustrated in Great Britain patent 1 201 663 to Arthur. The patent discloses an oil filter wrench which is comprised of shaft having two prongs, a flexible strap having loops which engage the prongs, the shaft is turned by a wrench or other means which in turn tightens the strap around the filter and turns the filter.

Still another strap wrench device is that shown in U.S. Pat. No. 4,079,642 to Scott. The Scott Patent discloses a wrench having a tension strap having a handle at one end and a buckle at the other end, a sliding or wrenching strap having one end secured to the buckle and the other end passed through the buckle to form a bight and terminated in a handle. The bight is placed around the oil filter and tighten by pull the handles which in turn rotates the oil filter.

These devices are comprised of essentially two types. One type, such as that described by Kaler, 2nd, and Robbins, utilize buckles or guides to form a bight in a strap pulled from one end. This may cause slippage of the bight around the filter during use. The second type, such as that described by Bracey, et al, Lewis and Arthur require external wrenching means such as conventional wrenches to tighten the straps. Using external wrenches may be difficult due to the limited and cramped space typically associated with engine compartments oil filters mounted to engine blocks.

Other strap wrench devices such as those described by Scott and Perrault would require the user to pull on the ends of two straps simultaneously to turn the oil filter. This may be difficult in the cramped quarters of engine compartments.

Consequently, a need exists for improvements in oil filter strap wrench designs to improve their use in cramped, limited space situations such as that associated with oil filters on engine blocks and to reduce the incidence of strap slippage when it is tightened around the filter.

SUMMARY OF INVENTION

The present invention provides an apparatus designed to satisfy the aforementioned needs. In the preferred embodiment, it is comprised of a flexible strap having a hand loop at one end and a pair of protruding tabs at the opposite end. Beginning at the end having the tabs, the strap is fitted on one side for a portion of its length with a series of rubber grip pads.

In use, the strap is rolled over the tabbed end into loops with the center loop slightly larger than the diameter of the oil filter to be removed. The strap loops are then slipped over and around the oil filter and the tabs are pressed against the sides of the filter. The strap end having the hand loop is used to pull the loops snug around the filter while the tabs are held against the filter. The tabs may then be released and further pulling of the hand loop tightens the loops which rotates the oil filter and unscrews it from the engine block.

DESCRIPTION OF PREFERRED EMBODIMENT

Figure 1:
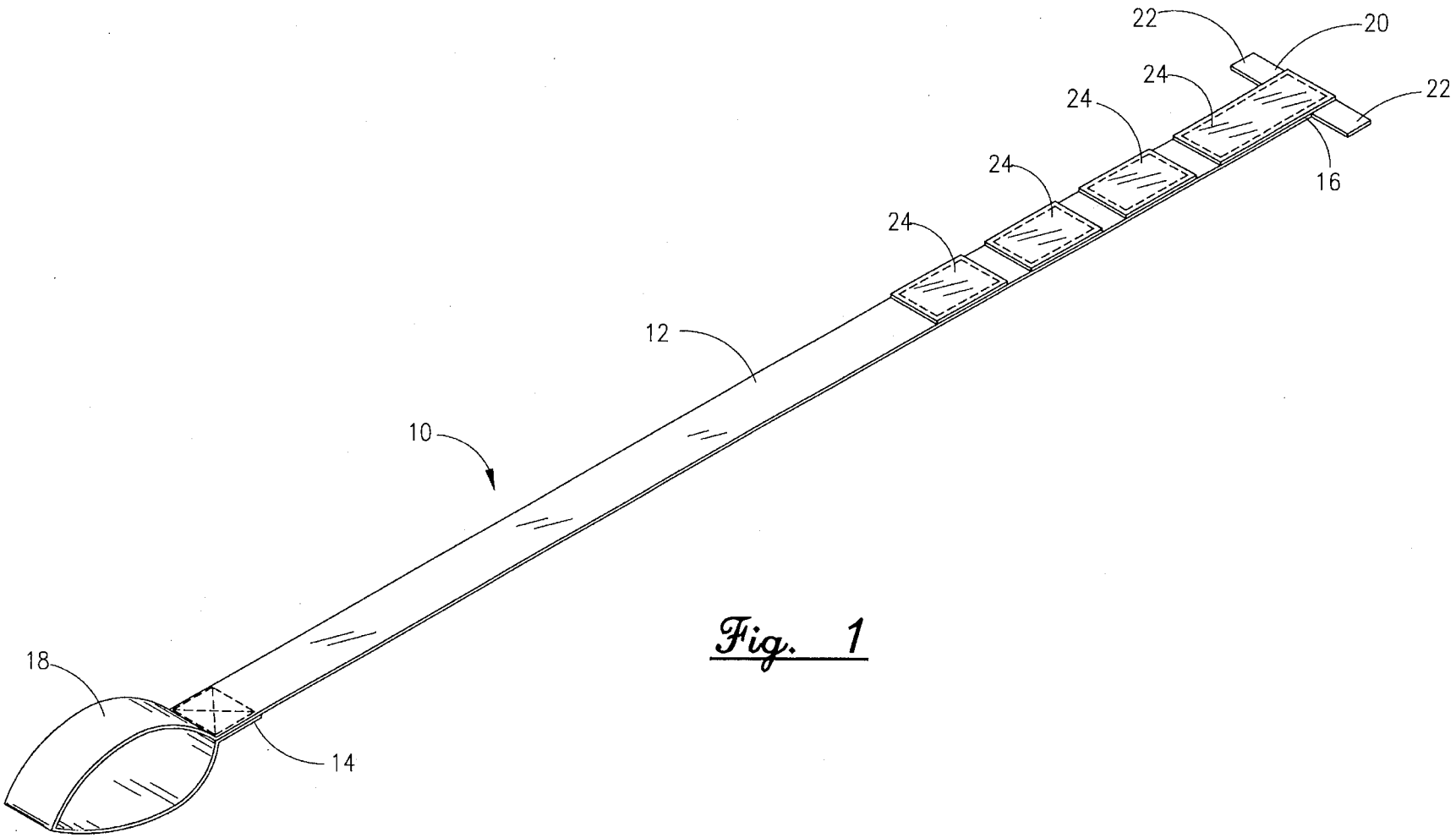
FIG. 1 is an isometric view of the unrolled strap wrench.

Referring now to the drawings and more particularly to FIG. 1 there is shown the preferred embodiment of the improved strap wrench 10. It is comprised of a flexible strap or belt 12 having ends 14 and 16. A hand loop 18 is formed by turning the end 14 back along a portion of the length of the strap 12 and securing the end 14 to the strap 12 by stitching, rivets or other means. The hand loop 18 provides a gripping means for pulling on the strap 12.

The width and length of the strap 12 may vary but should of a width to provide a sufficient frictional surface and of a length to provide several loops around a typical cylinder type oil filter. In the preferred embodiment, a minimum two inch width and sixty-two inch length, including the hand loop, was thought to be sufficient. This length is sufficient to provide at least three loops around a typical oil filter. The strap 12 may be made from any flexible belting material such as nylon, canvas, leather or the like. Nylon straps were utilized in the preferred embodiment.

At the end 16 of the strap 12 there is fixed a narrower transverse strap 20 perpendicular to the strap 12. The transverse strap 20 forms tabs 22 protruding from the edges of the strap 20. The tabs 22 provide a means to hold the strap 12 against an oil filter while the strap is tightened. In the preferred embodiment, the transverse strap 20 is one inch wide and the tabs 22 protrude approximately three-fourths of an inch from each edge of the strap 12. The transverse strap 20 is ideally made of rubber secured to the strap 12 by stitching or other means thought the strap may be formed from nylon of other material.

A rubber grip pads 24 are shown space along one face of the strap 12 beginning at the end 16. In the preferred embodiment, four pads were utilized space evenly apart along the length of the strap 12. It is thought that four pads being approximately two inches wide and three inches long spaced one inch apart would provide sufficient friction area for the strap against an oil filter. However, the number of pads and their dimensions may be varied and even a single pad would suffice. The pads 24 might be eliminated altogether if the material used to form strap 12 provided sufficient frictional resistance against an oil filter.

Figure 2:
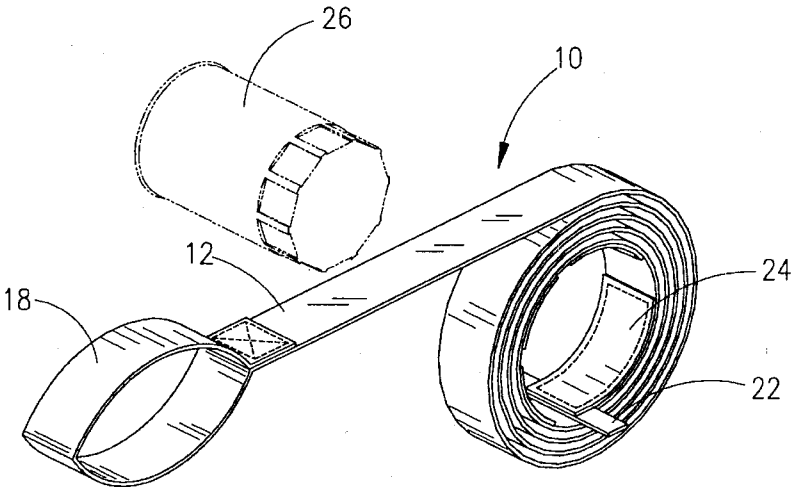
FIG. 2 is an isometric view of the strap wrench rolled up for placement over an oil filter.

Referring now to FIG. 2, there is shown the strap wrench 10 in which the strap 12 is rolled around the tabbed end 16 for placement over an oil filter 26. Ideally a minimum of three loops should be made though lesser or greater numbers of loops may suffice depending upon the clearance space available around the oil filter 26 and how tightly the filter is screwed to the engine block.

Figure 3:
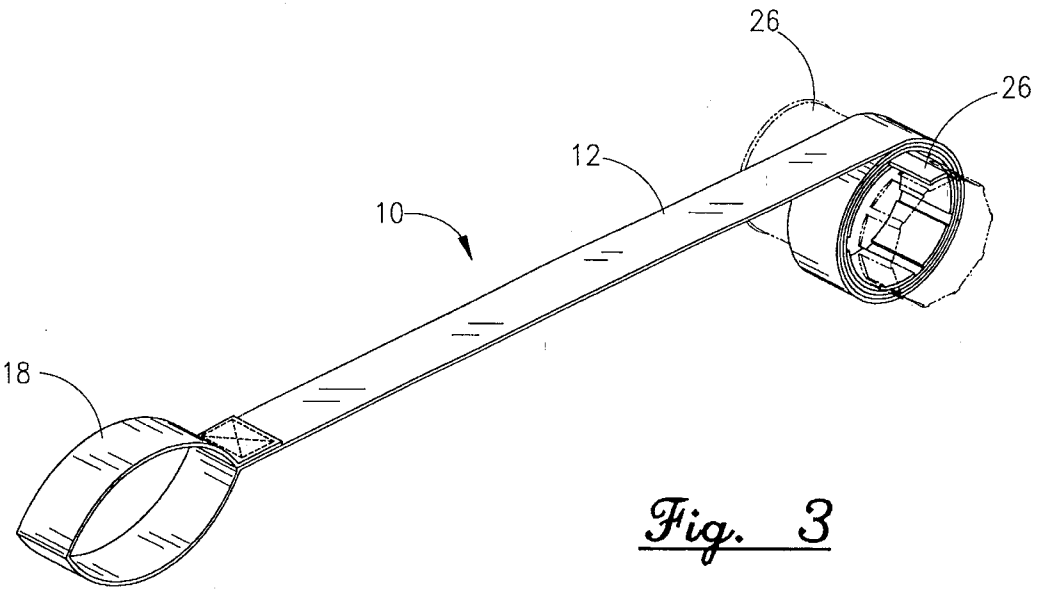
FIG. 3 is an isometric view of the strap wrench in place over an oil filter.

In use, as shown in FIG. 3, the surface of the oil filter 26 is wiped free of grease and oil. The strap 12 of the wrench 10 is rolled into at least three loops around the tabbed end 16, the loops being of sufficient diameter to be slipped over the end of the oil filter 26. The tabs 22 are then held against the surface of the oil filter 26 with the users thumb or fingers and the slack is pulled out of the loops by pulling on the strap 12 by means of the hand loop 18. As the slack is pulled out of the loops, the pads 24 grip the surface of the oil filter. Further, pulling turns the filter, unscrewing it from the engine block. The looped strap 12 may be reversed and placed over the oil filter for tightening if desired. Though the strap wrench 10 is designed to be used for removing cylindrical screw on oil filters from engine blocks, it can be readily seen that the device could be utilized as a strap wrench for turning other tubular or cylindrical objects.

It is thought that the improved oil filter strap wrench and the method of the present invention and many of its attendant advantages will be understood from the foregoing description. It is apparent that various changes may be make in the form, construction and arrangement of the parts thereof without departing from the spirit and scope of the invention or sacrificing all of its material advantages. The form described herein is merely a preferred or exemplary embodiment of the invention.

I claim:

1. A strap wrench for removing oil filters comprising:

a) a first flexible strap having first and second ends;

b) a hand loop formed at said first end of said strap; and c) a second strap mounted perpendicular to said first flexible strap at said second end of said first flexible strap, said second strap protruding from each edge of said first flexible strap so as to form a tab at each end, said first flexible strap having sufficient flexibility to be formed into a plurality of rolls around said tabbed second end so as to allow said rolled strap to be placed over said oil filter and tightened against said oil filter by holding at least one of said tabs against said oil filter and pulling on said hand loop at said first end of said flexible strap for turning said oil filter as said hand loop is pulled.

2. The strap wrench recited in claim 1, further comprising: a plurality of rubber grip pads mounted to said first flexible strap.

3. The strap wrench recited in claim 2 wherein said rubber grip pads are spaced uniformly along a segment of the length of said first flexible strap beginning at said second end of said flexible strap.

4. The strap wrench recited in claim 3 wherein said pads are rectangular.

5. The strap wrench as recited in claim 1 wherein said second strap is rubber.

6. The strap wrench as recited in claim 3 wherein said second strap is rubber.

7. The strap wrench as recited in claim 1 wherein said second strap is mounted to said first flexible strap by stitching.

8. The strap wrench as recited in claim 3 wherein said second strap and said pads are mounted to said first flexible strap by stitching.

9. A strap wrench for turning a tubular member comprising:

a) a longitudinal flexible first strap having first and second ends;

b) a transverse second strap mounted perpendicularly to said first strap at said second end of said first strap so as to form protruding tabs from each edge of said first strap;

c) a plurality of rubber pads mounted on one side of said first strap along a segment of its length beginning at said second end of said first strap, said flexible first strap having sufficient flexibility to be formed into a plurality of rolls around said tabbed second end so as to allow said rolled strap to be placed over said tubular member and tightened against said tubular member by holding at least one of said tabs against said tubular member and pulling on said first end of said flexible first strap for turning said tubular member as said first end is pulled.

* * * * *